US007233114B2

(12) United States Patent
Lee

(10) Patent No.: US 7,233,114 B2
(45) Date of Patent: Jun. 19, 2007

(54) APPARATUS FOR DRIVING LAMP OF LIQUID CRYSTAL DISPLAY DEVICE

(75) Inventor: Jeong Geun Lee, Daegu (KR)

(73) Assignee: LG.Philips LCD Co., Ltd, Seoul (KR)

( * ) Notice: Subject to any disclaimer, the term of this patent is extended or adjusted under 35 U.S.C. 154(b) by 0 days.

(21) Appl. No.: 11/152,186

(22) Filed: Jun. 15, 2005

(65) Prior Publication Data

US 2006/0001385 A1 Jan. 5, 2006

(30) Foreign Application Priority Data

Jun. 30, 2004 (KR) ..... 10-2004-0049956

(51) Int. Cl.
*H05B 37/02* (2006.01)

(52) U.S. Cl. ..... 315/219; 315/224; 315/308

(58) Field of Classification Search ..... 315/209 R, 315/210–212, 219, 224–225, 291, 307, 308, 315/312, 324, 226

See application file for complete search history.

(56) References Cited

U.S. PATENT DOCUMENTS

| | | | | |
|---|---|---|---|---|
| 5,930,121 | A * | 7/1999 | Henry | 363/16 |
| 5,952,791 | A * | 9/1999 | Watanabe et al. | 315/225 |
| 6,515,436 | B2 * | 2/2003 | Kobayashi et al. | 315/307 |
| 6,545,432 | B2 * | 4/2003 | Konopka | 315/291 |
| 6,597,130 | B2 * | 7/2003 | Lee et al. | 315/294 |
| 6,949,893 | B2 * | 9/2005 | Higuchi | 315/312 |

* cited by examiner

*Primary Examiner*—Thuy Vinh Tran
(74) *Attorney, Agent, or Firm*—McKenna Long & Aldridge LLP

(57) ABSTRACT

An apparatus for driving a lamp of a liquid crystal display device includes a transformer to supply a voltage to a lamp and a voltage detector having a first resistance connected between a secondary winding wire of the transformer and a ground voltage source, a rectifier connected to the secondary winding wire of the transformer, and a second resistance connected between the rectifier and the ground voltage source to detect a voltage induced onto the secondary winding wire of the transformer.

12 Claims, 9 Drawing Sheets

APPARATUS FOR DRIVING LAMP OF LIQUID CRYSTAL DISPLAY DEVICE

This application claims the benefit of Korean Patent Application No. P2004-049956 filed in Korea on Jun. 30, 2004, which is hereby incorporated by reference in its entirety.

BACKGROUND OF THE INVENTION

1. Field of the Invention

The present invention relates to a liquid crystal display device, and more particularly, to an apparatus for driving a lamp of a liquid crystal display.

2. Description of the Related Art

In general, a liquid crystal display (hereinafter, referred to as a "LCD") device has applications that are broadening due to its advantageous characteristics, such as lightweight, thin profile and low power consumption. The LCD device is typically used in office automation equipment, audio/video devices and the like. The LCD device displays a desired picture on a screen by controlling the amount of light transmitted through the device in accordance with a video signal applied via a plurality of control switches, which are arranged in a matrix form.

The LCD device needs a light source, such as a backlight, because the LCD device is not a light-emitting display device. A cold cathode fluorescent lamp (hereinafter, referred to as a "CCFL") is generally used as the light source in the backlight unit. The CCFL uses a cold emission phenomenon (i.e. electrons are emitted due to a strong electric field applied to the surface of a cathode) to provide light with a high brightness, a long life span and a full colorization. The CCFL has low heat generation. The CCFL can be used in different light guide systems, such as a direct illumination system or a reflection plate system. The type of light guide system adopted for a specific LCD device is based on the physical requirements of the LCD device.

The CCFL uses an inverter circuit to get a high voltage from a low voltage DC power source to drive the CCFL. FIG. 1 is a block diagram illustrating an apparatus for driving lamps of a liquid crystal display device according to the related art. FIG. 2 is a schematic block diagram illustrating the apparatus for driving the lamps of the liquid crystal display device shown in FIG. 1.

Referring to FIGS. 1 and 2, an apparatus for driving lamps of an LCD device according to the related art includes a lamp housing 10 having a plurality of lamps 12, an inverter part 4 with a plurality of inverters for supplying an output voltage to each of the lamps 12, a first printed circuit board 2 on which the inverter part 4 is mounted, and a second printed circuit board 6 on which the lamps 12 are commonly connected to the ground voltage source GND. The lamp housing 10 has a space provided for receiving the lamps. The lamp housing 10 is stacked onto a main support (not shown). Each lamp 12 receives a lamp output voltage from the inverter part 4 and emits visible light to a liquid crystal display panel (not shown).

Each of the lamps 12 includes a glass tube with an inert gas inside of the glass tube. One side of the lamp 12 is connected to a secondary winding wire T2 of a transformer 16, and another side of the lamp 12 is connected to the ground voltage source GND. The inside of the glass tube contains inert gas, such as Ar or Ne, as well as phosphorus spread over the inner wall of the glass tube. When a high AC voltage supplied from the inverter 20 is applied to an electrode of one of the lamps 12, electrons are emitted that collide with the inert gas inside the glass tube, thereby increasing the amount of electrons by geometric progression. The increased electrons cause electric current to flow inside of the glass tube, thereby exciting the inert gas to emit ultraviolet light. The ultraviolet light irradiates phosphorus, which is spread over the inner wall of the glass tube, to cause the emission of visible light.

The first printed circuit board 2 is arranged at one side of the main support (not shown). The second printed circuit board 6 is arranged at one side of the main support (not shown). Each inverter 8 included in the inverter part 4 of the first printed circuit board 2 includes a switch device 14 to switch a voltage from a voltage source Vin in response to a switching control signal, a transformer 16 to convert the voltage supplied by switching of the switch device 14 into an output voltage, a voltage detector 20 to detect the voltage of the inverter 8, and a controller (Pulse Width Modulation: PWM) 18 to switch the switch device 14 in response to a feedback voltage FB from the voltage detector 20. The switch device 14 switches the voltage from the voltage source Vin to the transformer 16 in response to the switching control signal from the controller 18.

The transformer 16 includes a primary winding wire T1 connected to the switch device 14 and a secondary winding wire T2 connected to the lamp 12. Both ends of the primary winding wire T1 are connected to the switch device 14 and one side of the secondary winding wire T2 is connected to one side of the lamp 12, and at the same time, the other end of the secondary winding wire T2 is connected to the voltage detector 20. The transformer 16 converts the voltage supplied to the primary winding wire T1 to an output voltage on the secondary winding wire T2 in a ratio corresponding to a winding wire ratio of primary and secondary winding wires T1 and T2. The output voltage induced onto the secondary winding wire T2 is supplied to the lamp 12 through one side of the lamp 12, thereby turning on the lamp 12.

The voltage detector 20 detects the output voltage or high AC voltage induced onto the secondary winding wire T2 of the transformer 16 to generate a feedback voltage FB. In the alternative, the voltage detector 20 may be located at the output terminal of the lamp 12 to detect the output value of the voltage outputted from the lamp 12. The controller 18 receives the feedback voltage FB generated from the voltage detector 20 to control a switching period of the switch device 14. In other words, when the feedback voltage FB is higher than a reference voltage for driving the lamp, the controller 18 reduces a width of the switching control signal supplied to the switch device 14 to make a switching time of the switch device 14 fast. Because of this, the voltage supplied from the voltage source Vin to the transformer 16 is reduced so that a current passing through the lamp 12 is reduced.

On the other hand, when the feedback voltage FB is lower than the reference voltage, the controller 18 increases the width of the switching control signal supplied to the switch device 14 to make the switching period of the switch device 14 slow. Because of this, the voltage supplied form the voltage source Vin to the transformer 16 increases so that the current passing through the lamp 12 increases. Accordingly, the voltage supplied to each lamp 12 is constantly maintained so that the brightness of the light generated from the lamps 12 is constantly maintained.

When the temperature decreases in the apparatus for driving the lamp of the liquid crystal display device according to the related art, the brightness of the light generated from the lamp 12 is reduced. FIG. 3 is a graph showing a tube current of the lamp over time for different temperatures while driving the lamp of the liquid crystal display device shown in FIG. 2. When the temperature decreases, gas movement of the gas charged in the lamp 12 reduces so as to increase the resistance of the lamp 12. Because of this, the supply voltage monitored by the voltage detector 20 connected to the other end of the secondary winding wire T2 in the transformer 16 increases so that the feedback voltage FB increases. Accordingly, the controller 18 makes the switching period of the switch device 14 fast, thereby reducing the voltage supplied from the voltage source Vin to the transformer 16. Thus, as shown in FIG. 3, the current passing through the lamp 12 is reduced. This causes a problem in that the brightness of the light generated from the lamp 12 decreases.

SUMMARY OF THE INVENTION

Accordingly, the present invention is directed to a to an apparatus for driving a lamp of a liquid crystal display that substantially obviates one or more of the problems due to limitations and disadvantages of the related art.

An object of the present invention to provide an apparatus for driving a lamp of a liquid crystal display device adaptive for stabilizing brightness irrespective of changes in ambient temperature.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, an apparatus for driving a lamp of a liquid crystal display device of the present invention includes a transformer to supply a voltage to a lamp, and a voltage detector including: a first resistance connected between a secondary winding wire of the transformer and a ground voltage source; a rectifier connected to the secondary winding wire of the transformer; and a second resistance connected between the rectifier and the ground voltage source to detect a voltage induced onto the secondary winding wire of the transformer.

In another aspect, an apparatus for driving a lamp of a liquid crystal display device according to the present invention includes a transformer to supply a voltage to a lamp, a switch device switched by a switching control signal to provide a supply voltage from a voltage source to the transformer, a voltage detector to detect the voltage supplied from the transformer and generate a feedback voltage and a controller to switch the switch device in response to the feedback voltage from the voltage detector, wherein the voltage detector includes: a first resistance connected between a secondary winding wire of the transformer and the ground voltage source to have a first resistance value to detect the voltage from a first current portion out of a total current induced onto the secondary winding wire of the transformer; a rectifier to rectify a second current portion out of a total current induced onto the secondary winding wire of the transformer; and a second resistance connected between the rectifier and the ground voltage source to have a second resistance value to detect the voltage with the second current portion rectified by the rectifier.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

DETAILED DESCRIPTION OF THE PREFERRED EMBODIMENTS

Reference will now be made in detail to the preferred embodiments of the present invention, examples of which are illustrated in the accompanying drawings.

Figure 1:
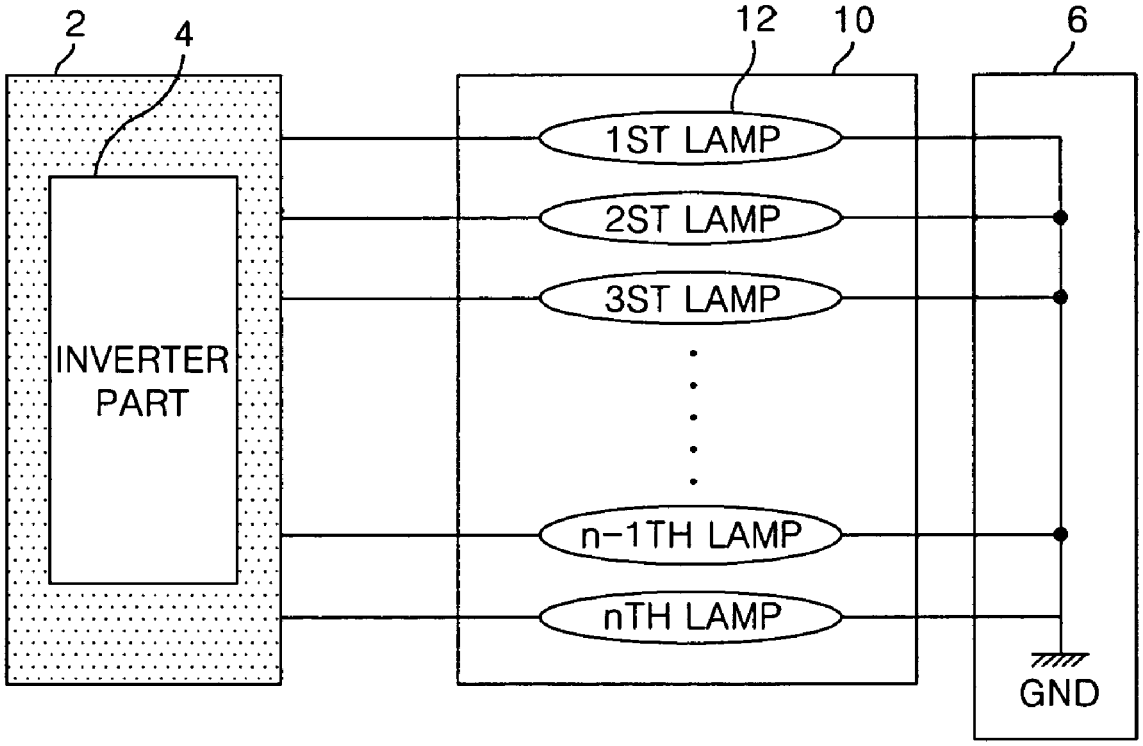
FIG. 1 RELATED ART
FIG. 1 is a block diagram illustrating an apparatus for driving a lamp of a liquid crystal display device according to the related art.
Figure 2:
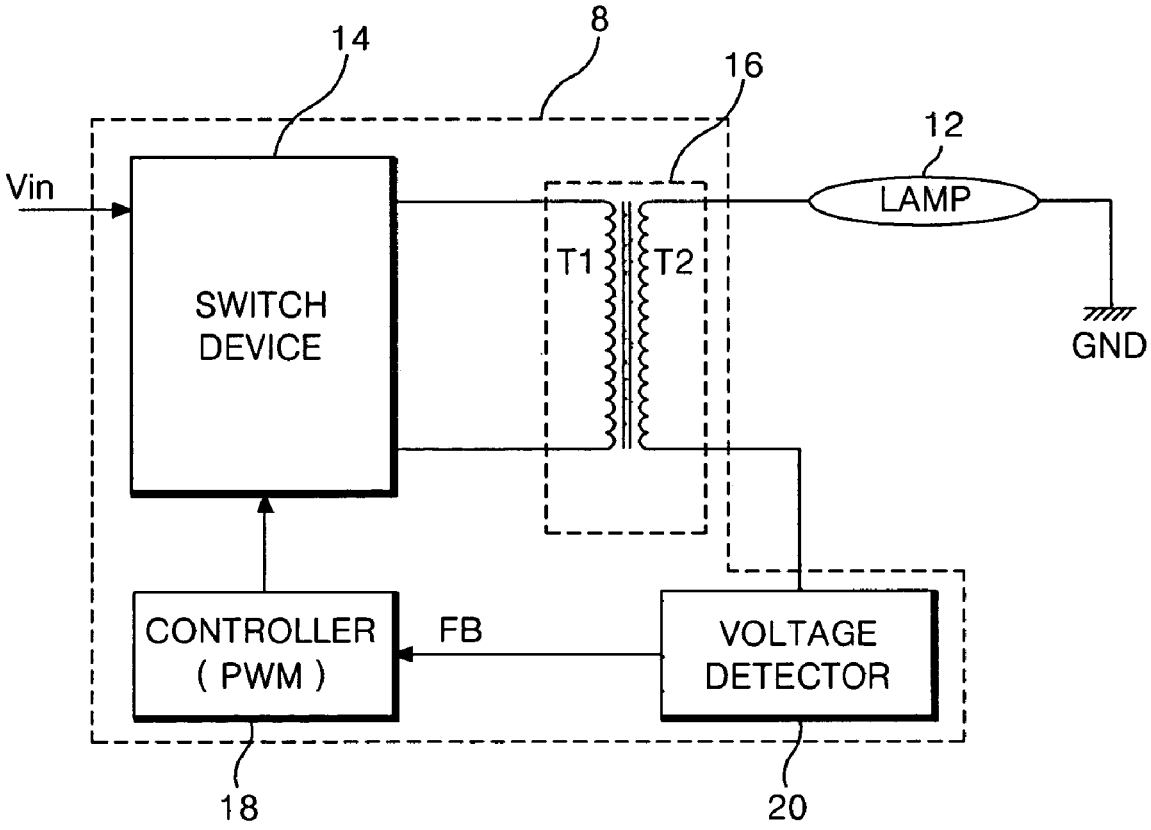
FIG. 2 RELATED ART
FIG. 2 is a schematic block diagram illustrating the apparatus for driving the lamp of the liquid crystal display device shown in FIG. 1.
Figure 3:
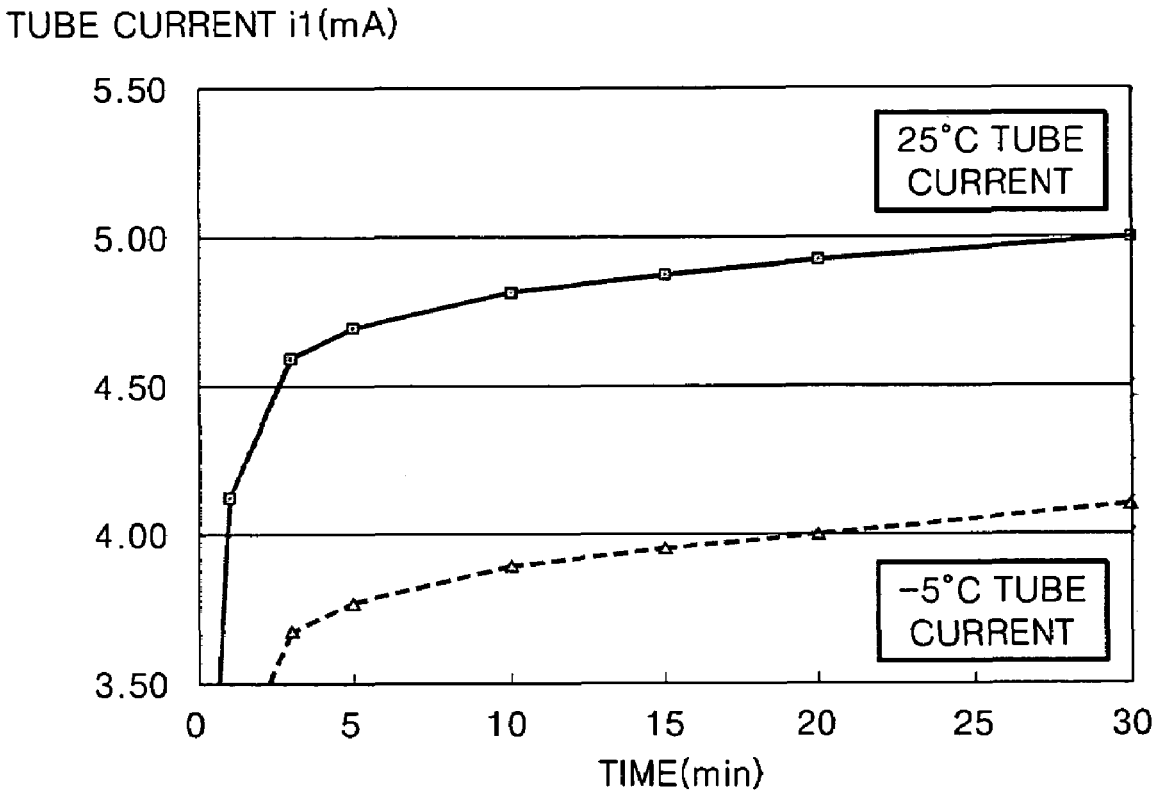
FIG.3 RELATED ART
FIG. 3 is a graph showing a tube current of the lamp over time for different temperatures while driving the lamp of the liquid crystal display device shown in FIG. 2.
Figure 4:
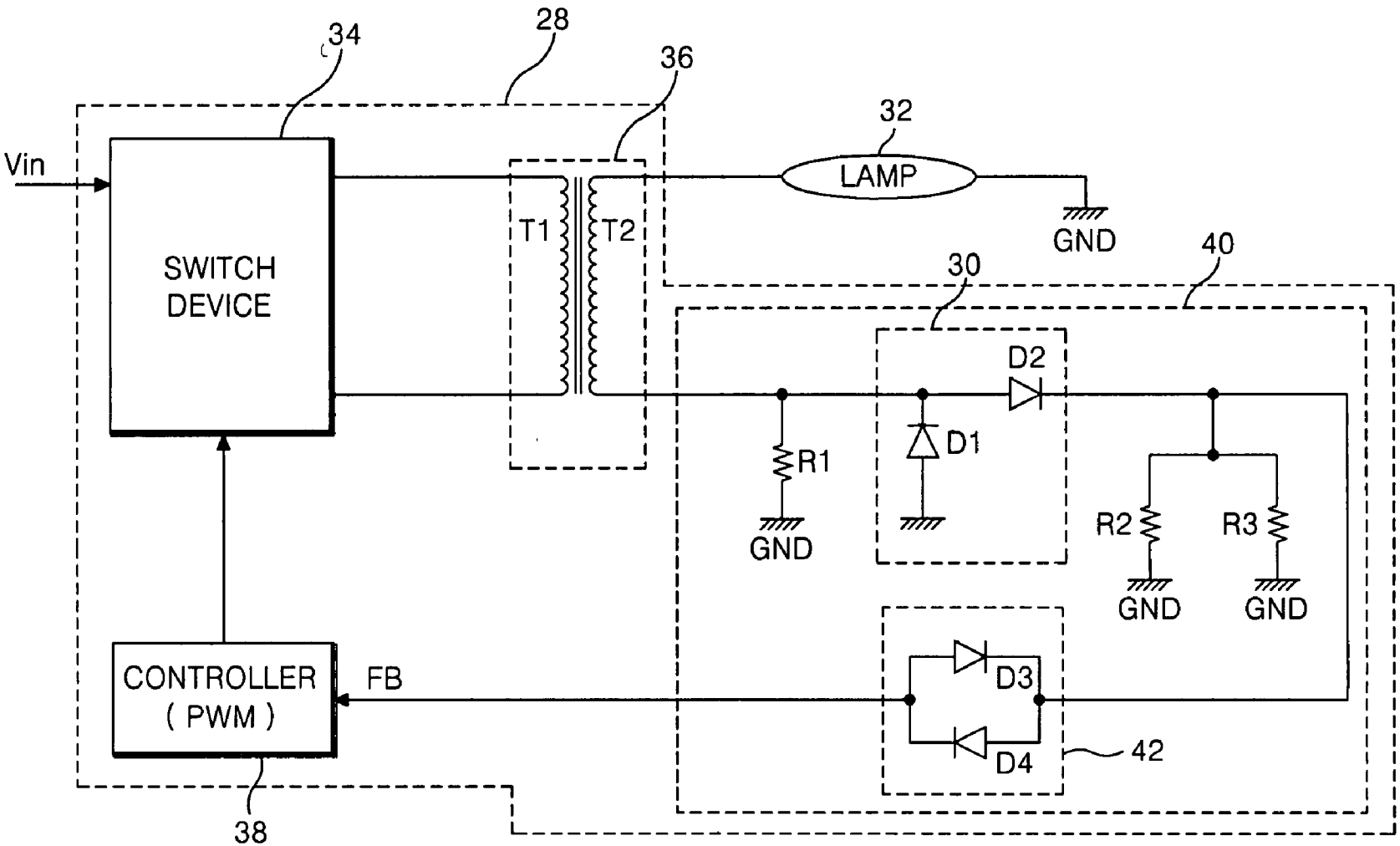
FIG. 4 is a block diagram illustrating an apparatus for driving a lamp of a liquid crystal display device according to a first embodiment of the present invention.

FIG. 4 is a block diagram illustrating an apparatus for driving a lamp of a liquid crystal display (LCD) device according to a first embodiment of the present invention. Referring to FIG. 4, an apparatus for driving a lamp of a LCD device according to the first embodiment of the present invention includes a plurality of lamps 32 to generate light, and an inverter 28 for supplying an output voltage to each of the lamps 32.

Each lamp 32 receives the output voltage from the inverter 28 to irradiate a liquid crystal display panel (not shown) with visible light. Each of the lamps 32 includes a glass tube with an inert gas inside of the glass tube. One side of the lamp 32 is connected to a secondary winding wire T2 of a transformer 36 and the other side of the lamp 32 is connected to the ground voltage source GND. The inside of the glass tube is charged with the inert gas and has phosphorus spread over the inner wall of the glass tube. When an AC voltage of the output voltage supplied from the inverter 28 is applied to a high voltage electrode of each lamp, electrons are emitted that collide with the inert gas inside the glass tube, thereby increasing the amount of electrons by geometric progression. The increase in electrons causes electric current to flow in the glass tube, thereby exciting the inert gas, such as Ar or Ne, to generate ultraviolet rays. The ultraviolet rays irradiate the phosphorus, which is spread over the inner wall of the glass tube, to cause the emission of visual light.

The inverter 28 includes a switch device 34 to switch a voltage from a voltage source Vin in response to a switching control signal, a transformer 36 to convert the voltage supplied by switching of the switch device 34 into an output voltage, a voltage detector 40 to detect the voltage of the inverter 28, and a controller (Pulse Width Modulation: PWM) 38 to switch the switch device 34 in response to a feedback voltage FB from the voltage detector 40. The switch device 34 switches the voltage from the voltage source Vin to the transformer 36 in response to the switching control signal from the controller 38.

The transformer 36 includes a primary winding wire T1 connected to the switch device 34 and a secondary winding wire T2 connected to the lamp 32. Both ends of the primary winding wire T1 are connected to the switch device 34 and one side of the secondary winding wire T2 is connected to one side of the lamp 32, and at the same time, the other end of the secondary winding wire T2 is connected to the voltage detector 40. The transformer 36 converts the supply voltage provided to the primary winding wire T1 to an output voltage on the secondary winding wire T2 in ratio corresponding to a winding wire ratio of primary and secondary winding wires T1 and T2. The output voltage(or current) induced onto the secondary winding wire T2 is supplied to the lamp 32 through one side of the lamp 32, thereby turning on the lamp 32.

The voltage detector 40 detects the voltage induced onto the secondary winding wire T2 of the transformer 36 to generate a feedback voltage FB. The voltage detector 40 includes a first resistance R1 to receive a first current portion of the total current induced onto the secondary winding wire T2, a rectifier 30 to rectify a second current portion of the total current induced onto the secondary winding wire T2, second and third resistances R2 and R3 to detect the voltage with the second current portion rectified by the rectifier 30, a voltage dropping part 42 for dropping the voltage to generate a feedback voltage FB. In the alternative, the voltage detector 40 may be connected to the output terminal of the lamp 32, and detects the output value outputted from the lamp 32.

The first resistance R1 is installed between the other end of the secondary winding wire T2 at the transformer 36 and the ground voltage source GND to detect the voltage corresponding to the first current portion of the total current induced onto the secondary winding wire T2 of the transformer 36. The strength of the total current induced onto the secondary winding wire T2 of the transformer 36 is almost similar in strength to the first current portion. In other words, most of the total current induced onto the secondary winding wire T2 is supplied to the first resistance R1. The first resistance R1 has a value in a range of about 200Ω to 430Ω in order to compensate for the tube current of the lamp 32 at a low temperature.

The rectifier 30 rectifies the second current portion of the total current induced onto the secondary winding wire T2 of the transformer 36. To this end, the rectifier 30 includes a first diode D1 connected at one side of the first resistance R1 and the ground voltage source GND, and a second diode D2 connected between the one side of the first diode D1, and the second and the third resistances R2 and R3.

The first diode D1 is connected between the first resistance R1 and the ground voltage source GND to detect the voltage with the second current portion and to maintain the second current portion. The second diode D2 is connected between the first diode D1 and the second and the third resistances R2 and R3 to rectify the second current portion. In other words, the second diode D2 passes a positive (+) current of the second current portion and intercepts a negative (−) current. Because of this, only the positive (+) second current portion is supplied to the second and the third resistances R2 and R3.

The second and the third resistances R2 and R3 are connected in parallel between an output terminal of the rectifier 30 and the ground voltage source GND to detect the voltage with the second current portion rectified by the rectifier 30. The second and the third resistances R2 and R3 can be combined as a single resistance. The combined resistance of the second and the third resistances R2 and R3 has a value in a range of about 15 kΩ to 35 kΩ to compensate for the tube current passing through the lamp 32 at a low temperature. Meanwhile, the combined resistance value of the first to the third resistances should be maintained in less than about 430Ω, e.g., 200Ω to 430Ω, in the case that a time constant is set so that the tube current of the lamp 32 is maintained in about 5 mA at a normal temperature.

The voltage dropping part 42 is connected between the controller 38 and the second and the third resistances R2 and R3 to drop the voltage detected from the second the third resistances R2 and R3 into a feedback voltage FB and to rectify the second current portion supplied from the second diode D2. To this end, third and fourth diodes D3 and D4 are connected in parallel with each other so that the voltage dropping part 42 forms a close loop.

The controller 38 receives the feedback voltage FB generated from the voltage detector 40 to control a switching period of the switch device 34. In other words, when the feedback voltage FB is higher than a reference voltage for driving the lamp 32, the controller 38 reduces a width of the switching control signal supplied to the switch device 34 to reduce the switching time of the switch device 34. Because of this, the voltage, supplied from the voltage source Vin to the transformer 36, is reduced so that a current passing through the lamp 32 is reduced. On the other hand, when the feedback voltage FB is lower than the reference voltage, the controller 38 increases the width of the switching control signal supplied to the switch device 34 to make the switching period of the switch device 34 slower. Because of this, the voltage supplied form the voltage source Vin to the transformer 36 increases, so that the current passing through the lamp 32 increases. Accordingly, the voltage supplied to each lamp 32 is maintained so that brightness of light generated from the lamps 32 is maintained.

An operation of the lamp driving apparatus by the controller 38 at a low temperature will now be described. When the inverter 28 is ON, a power generated to the preliminary winding wire T1 of the transformer 36 at an initial time is supplied to the secondary winding wire T2. Because of this, an initial current flows in the first resistance R1. The first resistance R1 is multiplied by the initial current, thereby forming a feedback voltage FB. At this moment, as the resistance value of the first resistance R1 decreases, the feedback voltage FB decreases. Accordingly, the controller 38 increases the width of the switching control signal to supply a larger voltage to the secondary winding wire T2 of the transformer 36. However, if the resistance value of the first resistance R1 becomes very small, then the voltage(or current) induced onto the secondary winding wire T2 of the transformer 36 becomes very large. Thus, in the apparatus for driving the lamp of the liquid crystal display device according to the first embodiment of the present invention, the resistance value of the first resistance R1 is maintained at about 200Ω to 430Ω. Accordingly, a large voltage is induced onto the secondary winding wire T2 of the transformer 36 as compared to the apparatus for driving the lamp of the liquid crystal display device according to the related art, so that the tube current passing through the lamp 32 increases.

TABLE 1

| First resistance (Ω) | 680 | 430 | 400 | 360 |
|---|---|---|---|---|
| Voltage (V) detected by the first resistance | 4.16 | 3.27 | 3.11 | 3.04 |
| Entire input current (A) of the inverter | 2.40 | 3.65 | 3.80 | 4.08 |

Table 1 represents the amount of change in the entire input current of the inverter in accordance with the first resistance R1 at the low temperature when the lamp 32 is normally operated at the normal temperature and the entire input current of the inverter 28 is about 3.7A upon a saturation of the lamp 32. As indicated in Table 1, when the resistance value of the first resistance R1 is less than 430Ω, e.g., 200Ω to 430Ω, it is possible to prevent brightness of light generated from the lamp from being decreased.

Figure 5:
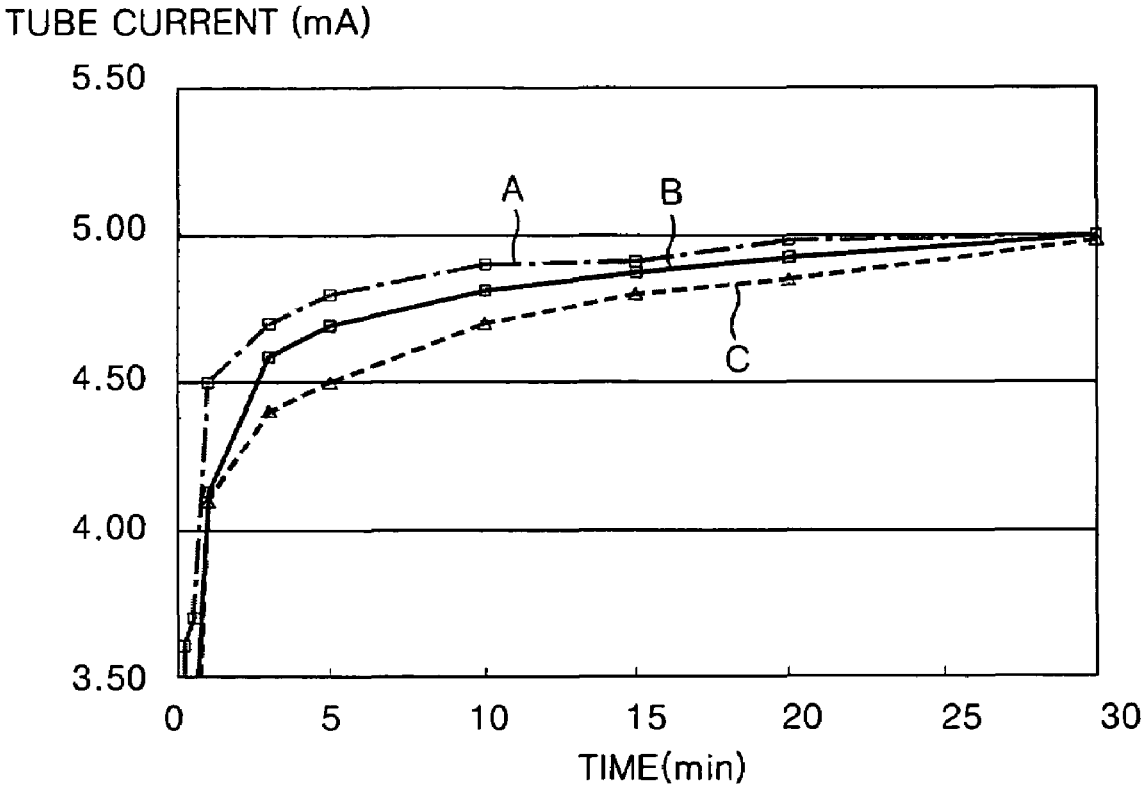
FIG. 5 is a graph showing a tube current of the lamp corresponding to changes of a temperature in the apparatus for driving the lamp of the liquid crystal display device shown in FIG. 4.

FIG. 5 is a graph showing a tube current of the lamp corresponding to a change of a temperature in the apparatus for driving the lamp of the liquid crystal display device shown in FIG. 4. The apparatus for driving the lamp of the liquid crystal display device according to the first embodiment of the present invention maintains a first resistance R1 to receive a first current portion out of the total current induced onto the secondary winding wire T2 of the transformer 36 to detect the voltage supplied to the lamp 32 as well as maintains the combined resistance value of the first to the third resistances R1 to R3 in less than 430Ω. Accordingly, a large number of current A as shown in FIG. 5 passes through the lamp 32 as compared with the current B passing through the lamp 32 at the normal temperature in the apparatus for driving the lamp of the liquid crystal display device. Further, even though the temperature changes in the apparatus for driving the lamp of the liquid crystal display device according to the first embodiment of the present invention, the amount of a total current C is almost similar in amount to the current B passing through the lamp 32 at normal temperatures. Accordingly, it is possible to prevent the brightness of the light generated from the lamp 32 from being lowered. Moreover, since the tube current passing through the lamp 32 has a quicker rise time due to the combined resistance of the first to the third resistances R1 to R3, it is possible to reduce a bright stabilization time so as to improve a display quality.

Figure 6:
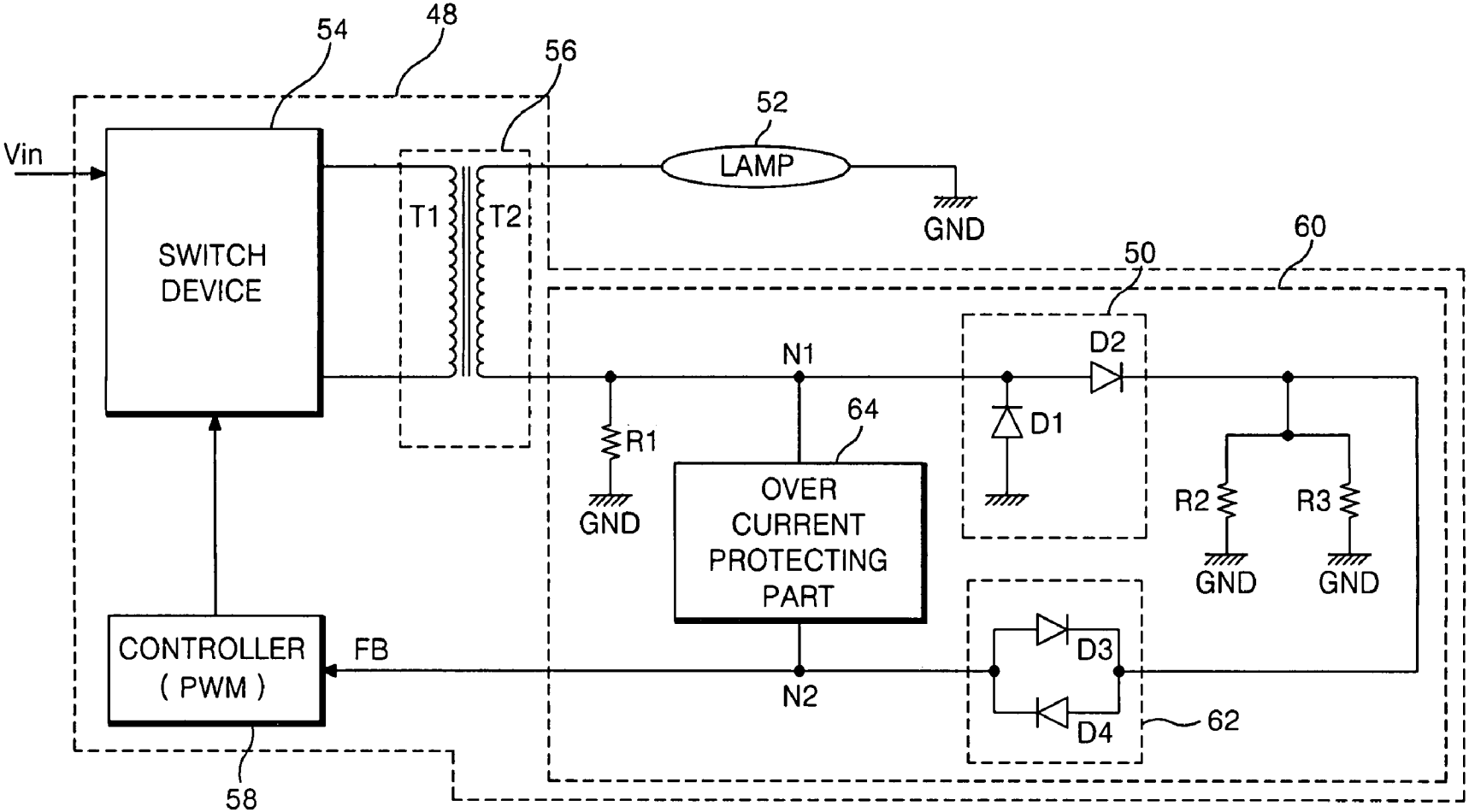
FIG. 6 is a block diagram illustrating an apparatus for driving a lamp of a liquid crystal display device according to a second embodiment of the present invention.
Figure 7:
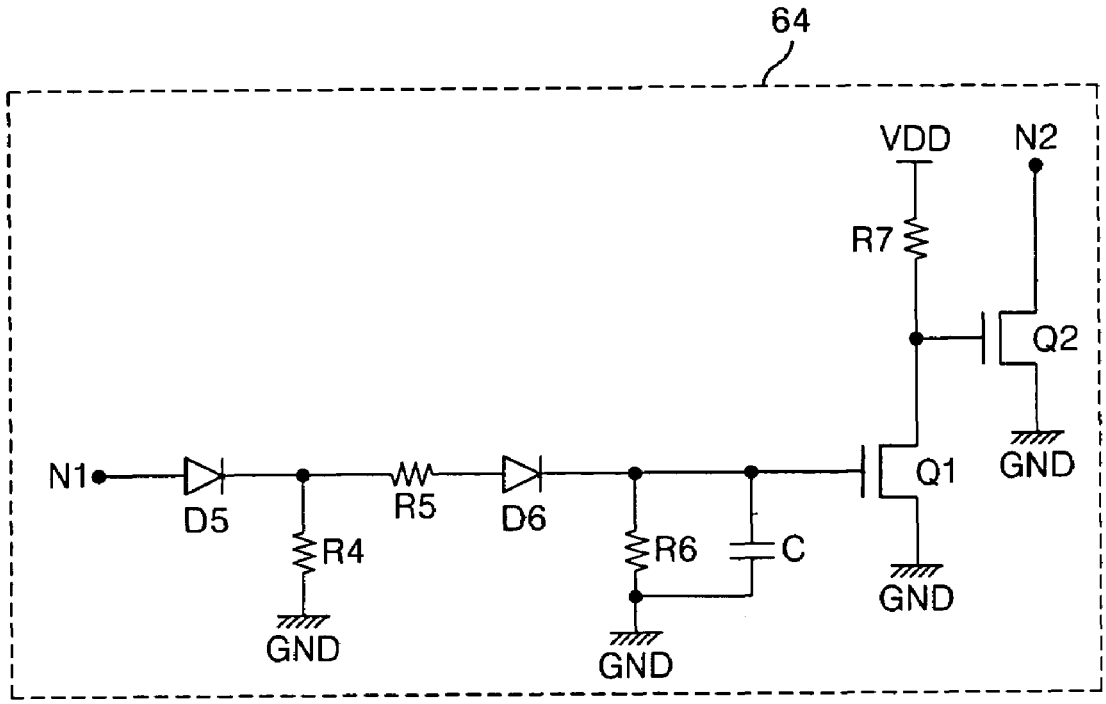
FIG. 7 is a circuit schematic of the over current protecting part shown in FIG. 6.

FIG. 6 is a block diagram illustrating an apparatus for driving a lamp of a liquid crystal display device according to a second embodiment of the present invention, and FIG. 7 is a circuit schematic showing an over current protecting part in FIG. 6. Referring to FIGS. 6 and 7, the apparatus for driving the lamp of the liquid crystal display device according to the second embodiment of the present invention has elements identical to those of the apparatus for driving the lamp of the liquid crystal display device according to the first embodiment except for the voltage detector, therefore the detailed description on the identical elements will be omitted.

The voltage detector 60 detects the output voltage induced onto the secondary winding wire T2 of the transformer 56, to generate a feedback voltage FB. The voltage detector 60 includes a first resistance R1 to receive a first current portion out of a total current induced onto the secondary winding wire T2 to detect an output voltage supplied to the lamp 52, a rectifier 50 to rectify a second current portion out of a total current induced onto the secondary winding wire T2, second and third resistances R2 and R3 to detect the voltage with the second current portion rectified by the rectifier 50; a voltage dropping part 62 for dropping the voltage detected by the second and the third resistances R2 and R3; and an over current protecting part 64 for preventing the tube current passing through the lamp 52 from being excessive. In the alternative, the voltage detector 60 may be located at the output terminal of the lamp 52, and detects the output value outputted from the lamp 52.

The first resistance R1 is installed between the other end of the secondary winding wire T2 at the transformer 56 and the ground voltage source GND to detect the output voltage and to received the first current portion out of a total current induced onto the secondary winding wire T2 of the transformer 56. The amount of the total current induced onto the secondary winding wire T2 of the transformer 56 is almost similar in amount to the first current portion. In other words, most of the total current induced onto the secondary winding wire T2 of the transformer 56 is supplied to the first resistance R1. The first resistance R1 has a value in a range of about 200Ω to 430Ω in order to compensate for the tube current of the lamp 52 at a low temperature.

The rectifier 50 rectifies a second current portion out of a total current induced onto the secondary winding wire T2 of the transformer 56. To this end, the rectifier 50 includes a first diode D1 connected one side of the first resistance R1 and the ground voltage source GND, and a second diode D2 connected between one side of the first diode D1 and the second and the third resistances R2 and R3.

The first diode D1 is connected between the first resistance R1 and the ground voltage source GND to detect the voltage with the second current portion and to maintain the second current portion. The second diode D2 is connected between the first diode D1 and the second and the third resistances R2 and R3 to rectify the second current portion. In other words, the second diode D2 passes a positive (+) current in the second current portion and intercepts a negative (−) current. Because of this, only the positive (+) second current portion is supplied to the second and the third resistances R2 and R3.

The second and the third resistances R2 and R3 are connected in parallel between an output terminal of the rectifier 50 and the ground voltage source GND to detect the output voltage with the second current portion rectified by the rectifier 50. The second and the third resistances R2 and R3 can be combined as a single resistance. The combined resistance of the second the third resistances R2 and R3 has a value in a range of about 15 kΩ to 35 kΩ to compensate the tube current passing through the lamp 52 at a low temperature. Meanwhile, the combined resistance value of the first to the third resistances should be maintained in about 430Ω, e.g., 200Ω to 430Ω in the case that a time constant is set so that the tube current of the lamp 52 is maintained in about 5 mA at a normal temperature.

The voltage dropping part 62 is connected between the controller 58 and the second and the third resistances R2 and R3 to drop the voltage detected from the second the third resistances R2 and R3, and to rectify the second current portion supplied from the second diode D2. To this end, third and fourth diodes D3 and D4 are connected in parallel from each other so that the voltage dropping part 62 forms a close loop.

The over current protecting part 64 is installed between a first node N1 and a second node N2 to prevent the tube current from being excessive such that the first node N1 is formed between the first resistance R1 and the rectifier 50, and the second node N2 is formed between the controller 58 and the voltage dropping part 62. To this end, the over current protecting part 64, as shown in FIG. 7, includes a fifth diode D5 rectifies a third current portion out of a total current induced onto the secondary winding wire T2 of the transformer 56, fourth and fifth resistances R4 and R5 for dividing a voltage from the third current rectified by the fifth diode D5, a sixth diode D6 for rectifying the current divided by the fourth and the fifth resistances R4 and R5, a sixth resistance R6 for detecting a voltage with the current rectified by the sixth diode D6, a sixth resistance for detecting a voltage with the current rectified by the sixth diode D6, a capacitor C for fixedly maintaining the voltage detected by the sixth resistance R6, a driving voltage source VDD for driving first and second switches Q1 and Q2, a seventh resistance R7 for reducing a voltage applied from the driving voltage source VDD, the first switch turned-on or turned-off by the voltage detected by the sixth resistance R6, and the second switch Q2 turned-on or turned-off by the first switch Q1.

When the tube current passing through the lamp 52 is excessive, i.e., when a voltage is excessively induced onto the secondary winding wire T2 of the transformer 56, the over current protecting part 64 turns-off the first switch Q1 and turns-on the second switch Q2, to thereby intercept the voltage supplied to the lamp 52. In other words, when an excessive current is induced onto the secondary winding wire T2 of the transformer 56, the first current portion out of a total current induced onto the secondary winding wire T2 is supplied to the first resistance R1 and the second current portion further including induced over currents is supplied to the rectifier 50. At this moment, a second current portion much larger than the second current portion normally supplied when driving the lamp 52 is supplied to the rectifier 50. The rectifier 50 rectifies the second current portion supplied thereto to apply only positive (+) current to the second and the third resistances R2 and R3. Accordingly, the second and the third resistances R2 and R3 detect a voltage with the second current portion supplied thereto. Thereafter, the voltage detected by the second and the third resistances R2 and R3 is dropped by the voltage dropping part 62 maintained on the second node N2.

The second current portion out of a total current induced onto the secondary winding wire T2 is rectified by the fifth diode D5, so that only positive (+) current is supplied to the fourth and the fifth resistances R4 and R5, and the second current supplied to the fourth and the fifth resistances R4 and R5 is divided by the fourth and the fifth resistances R4 and R5. In other words, when the resistance value of the fourth resistance R4 is larger than an entire resistance value of circuit devices installed after the fifth resistance R5, a current rectified by the diode D5 is supplied to the fifth resistance R5 more than the fourth resistance R4. Because of this, the fifth resistance R5 maintains the voltage higher than that of the fourth resistance R4. However, when the resistance value of the fourth resistance R4 is smaller than the entire resistance value of circuit devices installed after the fifth resistance R5, more current is supplied to the fourth resistance R4 than the fifth resistance R5. Because of this, the fourth resistance R4 maintains a higher voltage than that of the fifth resistance R5. The resistance value of the fourth and the fifth resistances R4 and R5 can be optionally changed. A third current portion out of a total current induced onto the secondary winding wire T2 of the transformer 56 is divided by the fourth and the fifth resistances R4 and R5 is rectified by the sixth diode D6, and a voltage from the current rectified by the sixth diode D6 is detected by the sixth resistance R6. At this moment, the voltage detected by the sixth resistance R6 becomes larger than a voltage supplied to a drain terminal of the first switch Q1, to thereby turn off the first switch Q1. Because of this, the second switch Q2 is turned-on, so that the voltage existed on the second node N2 is transmitted to the ground voltage source GND via the second switch Q2. Accordingly, the feedback voltage FB from the voltage detector 60 is not transmitted to the controller 58, so that the controller 58 intercepts a switching of the switch device 54 to intercept the voltage supplied to the lamp 52.

The apparatus for driving the lamp of the liquid crystal display device according to the second embodiment of the present invention maintains the first resistance R1 in less than 430Ω, as well as maintains the combined resistance value of the first to the third resistances R1 to R3 in less than 430Ω, so that even through the temperature changes, it is possible to prevent the tube current passing through the lamp 52 from being reduced. Accordingly, it is possible to prevent the brightness of the light generated from the lamp 52 from being lowered. Moreover, since the tube current passing through the lamp 52 has increased rise time due to the combined resistance of the first to the third resistances R1 to R3, it is possible to reduce a bright stabilization time on a screen, as well as, to improve a display quality. Further, it is possible to protect the lamp 52 by intercepting a power supply supplied to the lamp 52 when an excessive tube current passes through the lamp 52.

Figure 8:
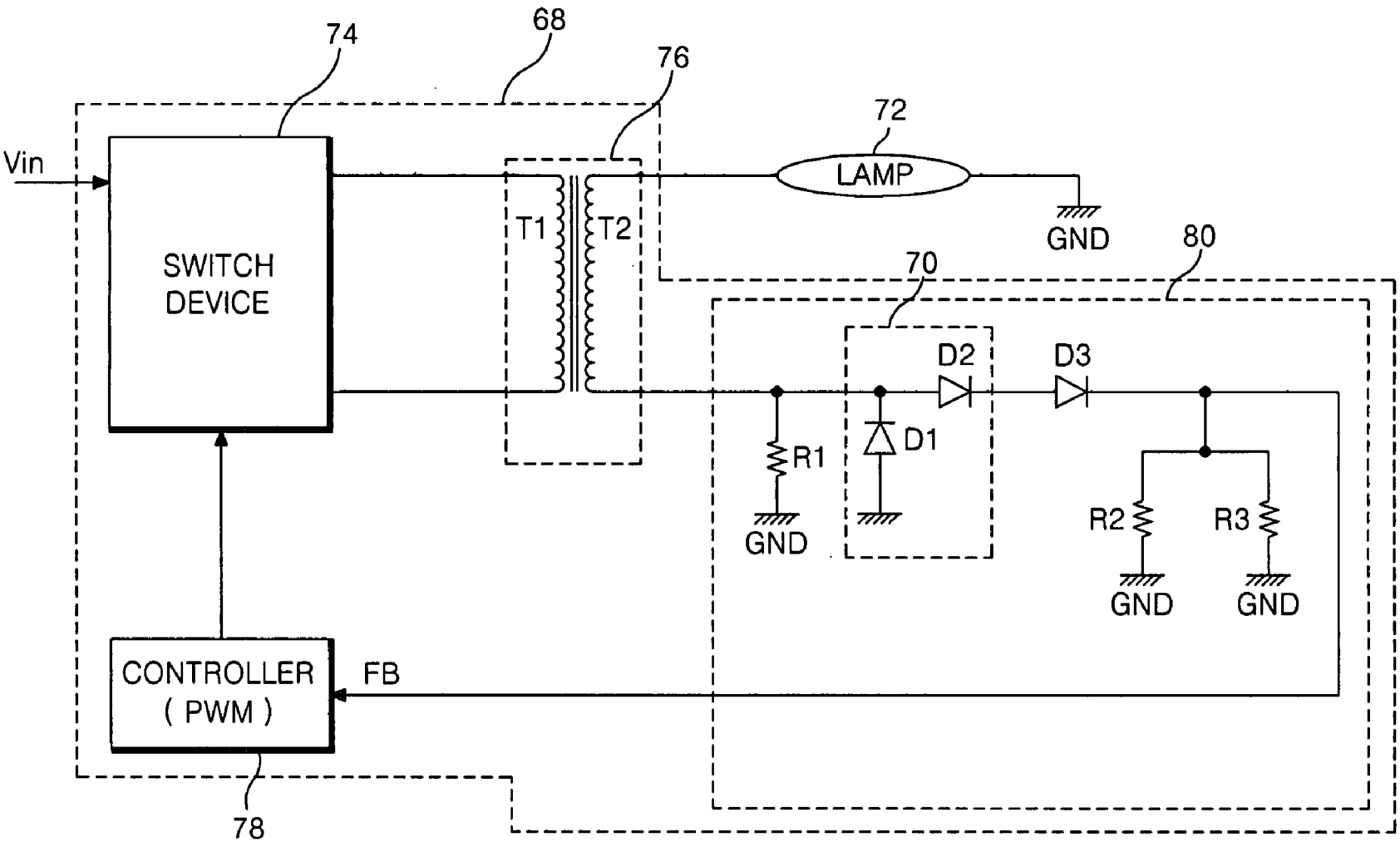
FIG. 8 is a block diagram illustrating an apparatus for driving a lamp of a liquid crystal display device according to a third embodiment of the present invention.

FIG. 8 is a block diagram illustrating an apparatus for driving a lamp of a liquid crystal display device according to a third embodiment of the present invention. Referring to FIG. 8, the apparatus for driving the lamp of the liquid crystal display device according to the third embodiment of the present invention has the elements identical to those of the apparatus for driving the lamp of the liquid crystal display device according to the first embodiment except for the voltage detector, the detailed description on the identical elements will be omitted.

The voltage detector 80 detects the output voltage induced onto the secondary winding wire T2 of the transformer 76, to generate a feedback voltage FB. The voltage detector 80 includes a first resistance R1 to receive a first current portion out of a total current induced onto the secondary winding wire T2 to detect an output voltage supplied to the lamp 72, a rectifier 70 to rectify a second current portion out of a total current induced onto the secondary winding wire T2, a third diode D3 for rectifying the second current portion rectified by the rectifier 70 and dropping a voltage, and second and third resistances R2 and R3 to detect an output voltage with the second current portion rectified by the third diode D3.

The first resistance R1 is installed between the other end of the secondary winding wire T2 at the transformer 76 and the ground voltage source GND to detect the output voltage and to receive the first current portion out of a total current induced onto the secondary winding wire T2. At this moment, the amount of the current induced onto the secondary winding wire T2 of the transformer 76 is almost similar to the first current. In other words, most of the current induced onto the secondary winding wire T2 of the transformer 76 is supplied to the first resistance R1. The first resistance R1 has a value in a range of about 200Ω to 430Ω in order to compensate for the tube current of the lamp 72 at a low temperature.

The rectifier 70 rectifies the second current among the currents induced onto the secondary winding wire T2 of the transformer 76. To this end, the rectifier 70 includes a first diode D1 connected one side of the first resistance R1 and the ground voltage source GND, and a second diode D2 connected between one side of the first diode D1 and the second and the third resistances R2 and R3. The first diode D1 is connected between the first resistance R1 and the ground voltage source GND to detect the voltage with the second current and to maintain the second current. The second diode D2 is connected between the first diode D1 and the second and the third resistances R2, R3 to rectify the second current. In other words, the second diode D2 passes a positive (+) current in the second current and intercepts a negative (−) current. Because of this, only the positive (+) current is supplied to the third diode D3. The third diode D3 rectifies the current rectified by the rectifier 70 and drops the voltage detected by the first diode D1.

The second and the third resistances R2 and R3 are connected in parallel between an output terminal of the third diode D3 and the ground voltage source GND to detect the voltage from the current rectified by the third diode D3. The second and the third resistances R2 and R3 can be combined as a single resistance. The combined resistance of the second the third resistances R2 and R3 has a value in a range of about 15 kΩ to 35 kΩ to compensate for the tube current passing through the lamp 72 at a low temperature. Meanwhile, the combined resistance value of the first to the third resistances should be maintained in about 430Ω, e.g., 200Ω to 430Ω in a case that a time constant is set so that the tube current of the lamp 72 is maintained in about 5 mA at a normal temperature.

The apparatus for driving the lamp of the liquid crystal display device according to the third embodiment of the present invention maintains the first resistance R1 in less than 430Ω, as well as maintains the combined resistance value of the first to the third resistances R1 to R3 in less than 430Ω, so that even through the temperature of circumstances is changed, it is possible to prevent the tube current passing through the lamp 72 from being reduced. Accordingly, it is possible to prevent the brightness of the light generated from the lamp 72 from being reduced. Moreover, since the tube current passing through the lamp 72 has a quicker rise time due to the combined resistance of the first to the third resistances R1 to R3, it is possible to reduce a bright stabilization time, as well as, to improve a display quality.

Figure 9:
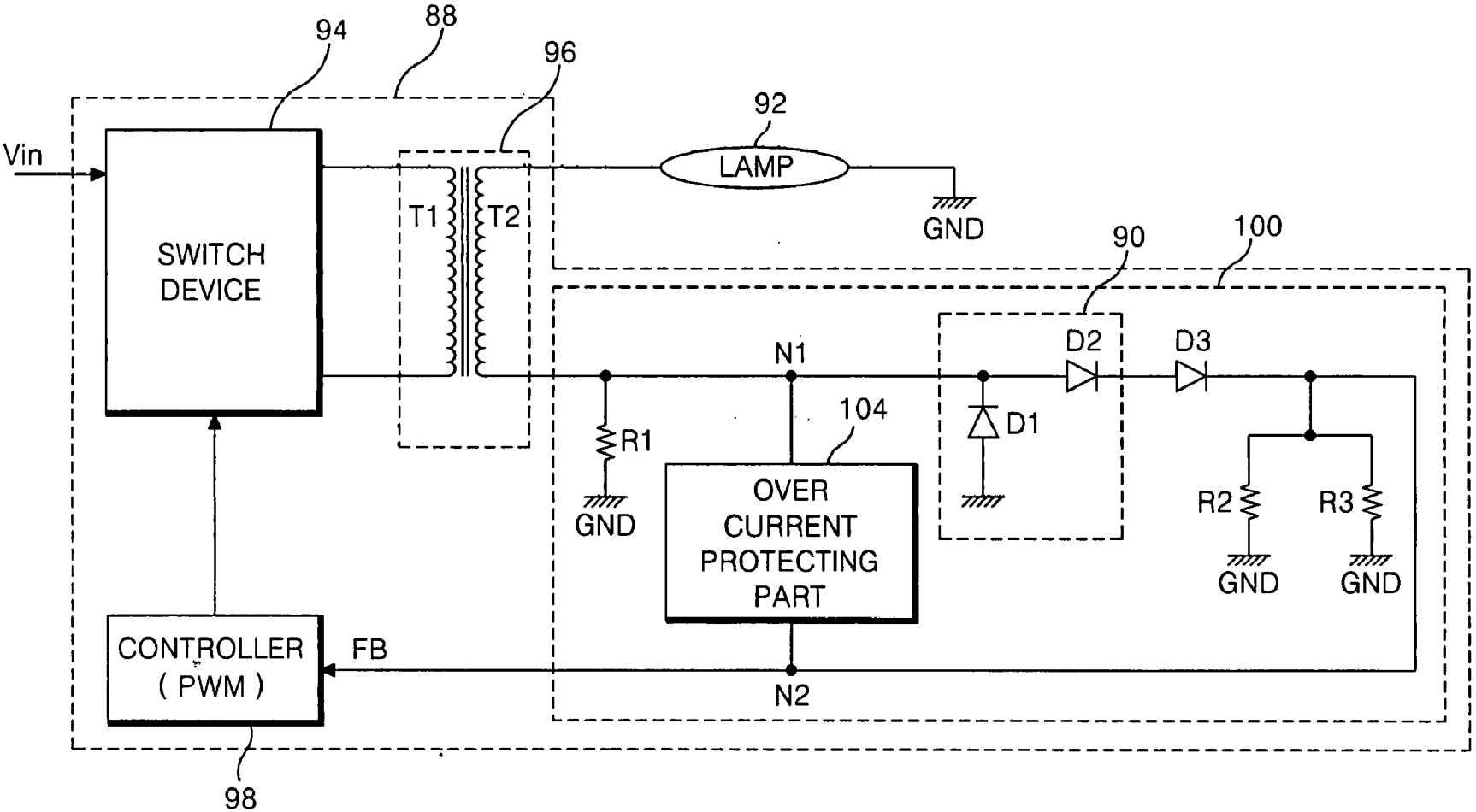
FIG. 9 is a block diagram illustrating an apparatus for driving a lamp of a liquid crystal display device according to a fourth embodiment of the present invention.

FIG. 9 is a block diagram illustrating an apparatus for driving a lamp of a liquid crystal display device according to a fourth embodiment of the present invention. Referring to FIG. 9, the apparatus for driving the lamp of the liquid crystal display device according to the fourth embodiment of the present invention has the elements identical to those of the apparatus for driving the lamp of the liquid crystal display device according to the second embodiment except for the voltage detector, the detailed description on the identical elements will be omitted.

The voltage detector 100 detects the voltage induced onto the secondary winding wire T2 of the transformer 96, to generate a feedback voltage FB. The voltage detector 100 includes a first resistance R1 to receive a first current among currents induced onto the secondary winding wire T2 of the transformer 96 to detect a voltage supplied to the lamp 92, a rectifier 90 to rectify a second current portion out of the total current induced onto the secondary winding wire T2 of the transformer 96, a third diode D3 for rectifying the current rectified by the rectifier 90 and dropping a voltage detected by the rectifier 90, second and third resistances R2 and R3 to detect a voltage with the second current rectified by the third diode D3, and an over current protecting part 104 for preventing the tube current passing through the lamp 92 from being excessive. The voltage detector 100 may be located at the output terminal of the lamp 92, and detects the output value outputted from the lamp 92.

The first resistance R1 is installed between the other end of the secondary winding wire T2 at the transformer 96 and the ground voltage source GND to detect the voltage, received the first current among the currents induced onto the secondary winding wire T2 of the transformer 96 to supply to the lamp 92. At this moment, the amount of the total current induced onto the secondary winding wire T2 of the transformer 96 is almost similar to the first current. In other words, most of the current induced onto the secondary winding wire T2 of the transformer 96 is supplied to the first resistance R1. The first resistance R1 has a value in a range of about 200Ω to 430Ω in order to compensate for the tube current of the lamp 92 at a low temperature.

The rectifier 90 rectifies rectifies a second current portion out of a total current induced onto the secondary winding wire T2 of the transformer 96. To this end, the rectifier 90 includes a first diode D1 connected to one side of the first resistance R1 and the ground voltage source GND, and a second diode D2 connected between one side of the first diode D1 and the second and the third resistances R2 and R3.

The first diode D1 is connected between the first resistance R1 and the ground voltage source GND to detect the voltage with the second current and to maintain the second current. The second diode D2 is connected between the first diode D1 and the second and the third resistances R2 and R3 to rectify the second current. In other words, the second diode D2 passes a positive (+) current in the second current and intercepts a negative (−) current. Because of this, only the positive (+) current is supplied to the third diode D3. The third diode D3 drops the voltage detected by the firs diode D1 and rectifies the current rectified by the second diode D2.

The second and the third resistances R2 and R3 are connected in parallel between an output terminal of the third diode D3 and the ground voltage source GND to detect the voltage from the current rectified by the third diode D3. The second and the third resistances R2 and R3 can be combined as a single resistance. The combined resistance of the second the third resistances R2 and R3 has a value in a range of about 15 kΩ to 35 kΩ to compensate for the tube current passing through the lamp 92 at a low temperature. Meanwhile, the combined resistance value of the first to the third resistances should be maintained in about 430Ω, e.g., 200Ω to 430Ω in the case that a time constant is set so that the tube current of the lamp 92 is maintained about 5 mA at a normal temperature.

The over current protecting part 104 has elements identical to those of the over current protecting part 64 described in the apparatus for driving the lamp of the liquid crystal display device according to the second embodiment of the present invention, therefore the detailed description on the over current protecting part 104 will be omitted.

The apparatus for driving the lamp of the liquid crystal display device according to the fourth embodiment of the present invention has the first resistance R1 of less than 430Ω, as well as the combined resistance value of the first to the third resistances R1 to R3 in less than 430Ω, so that even though the temperature changes, it is possible prevent the tube current passing through the lamp 92 from being reduced. Accordingly, it is possible to prevent the brightness of the light generated from the lamp 92 from being lowered. Moreover, since the tube current passing through the lamp 92 has a sudden inclination at start-up due to the combined resistance of the first to the third resistances R1 to R3, it is possible to reduce the bright stabilization time, as well as, to improve a display quality. Further, it is possible to protect the lamp 92 by reducing power supplied to the lamp 92 when an excessive amount of tube current passes through the lamp 92.

As described above, the apparatus for driving the lamp of the liquid crystal display device according to the embodiments of the present invention sets the resistance, detecting the voltage induced onto the secondary winding wire of the transformer, in less than 430Ω, so that even though the temperature changes, it is possible to prevent the tube current passing through the lamp from being reduced. Accordingly, it is possible to prevent the brightness of the light generated from the lamp from being reduced. Moreover, since the tube current passing through the lamp has a sudden inclination at start-up due to the resistance value, it is possible to reduce the bright stabilization time, as well as, to improve a display quality. Further, it is possible to protect the lamp by reducing power supplied to the lamp when an excessive tube current passes through the lamp.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. An apparatus for driving a lamp of a liquid crystal display device comprising:

a transformer to supply a voltage to a lamp;

a voltage detector including a first resistance connected between a secondary winding wire of the transformer and a ground voltage source, a rectifier connected to the secondary winding wire of the transformer, and a second resistance connected between the rectifier and the ground voltage source to detect a voltage induced onto the secondary winding wire of the transformer; and an over current protecting part having one end connected to the secondary winding wire of the transformer, and another end connected to a feedback line connected to a controller to prevent an excessive tube current from passing through the lamp, wherein the first resistance has a resistance value in range of about 200Ω to 430Ω and the second resistance has a resistance value in a range of 15 kΩ to 35 kΩ.

2. The apparatus according to claim 1, wherein the first resistance and the second resistance are connected in parallel with each other.

3. The apparatus according to claim 1, wherein a combined resistance of the first and the second resistances has a value in a range of 200Ω to 430Ω.

4. The apparatus according to claim 1, wherein the rectifier includes:

a first diode connected between the ground voltage source and a first node of both the secondary winding wire of the transformer and the first resistance; and a second diode connected between the second resistance and a second node of both the secondary winding wire of the transformer and the first diode.

5. The apparatus according to claim 1, further comprising:

a switch device to provide a supply voltage from a voltage source to the transformer; and the controller to control the switch device in response to the voltage from the voltage detector.

6. The apparatus according to claim 5, further comprising a voltage dropping part to drop the voltage detected by the second resistance.

7. The apparatus according to claim 5, further comprising a third diode to reduce the voltage detected by the rectifier.

8. The apparatus according to claim 1, wherein the over current protecting part includes:

a fourth diode connected between an input terminal of the rectifier and an input terminal of the controller to rectify a signal;

a third resistance connected between one side of the fourth diode and the ground voltage source to detect a voltage of the signal rectified by the fourth diode;

a fourth resistance connected to the third resistance in parallel to divide the signal rectified by the fourth diode;

a fifth diode to rectify a signal supplied to the fourth resistance;

a fifth resistance connected between the fifth diode and the ground voltage source to a voltage of the signal rectified by the fifth diode; and a capacitor connected to the fifth resistance in parallel to maintain the voltage detected by the fifth resistance.

9. The apparatus according to claim 8, wherein the over current protecting part includes:

a driving voltage source;

a sixth resistance to drop a voltage of the driving voltage source;

a first switch connected between the sixth resistance and the ground voltage source to be turned on or turned off by the voltage detected by the fifth resistance; and a second switch connected between the controller and the ground voltage source to be turned off when the first switch is turned on.

10. An apparatus for driving a lamp of a liquid crystal display device comprising:

a transformer to supply a voltage to a lamp;

a switch device switched by a switching control signal to provide a supply voltage from a voltage source to the transformer;

a voltage detector to detect the voltage supplied from the transformer and generate a feedback voltage;

a controller to switch the switch device in response to the feedback voltage from the voltage detector, wherein the voltage detector includes:

a first resistance connected between a secondary winding wire of the transformer and the ground voltage source to have a first resistance value to detect the voltage from a first current portion out of a total current induced onto the secondary winding wire of the transformer;

a rectifier to rectify a second current portion out of a total current induced onto the secondary winding wire of the transformer; and a second resistance connected between the rectifier and the ground voltage source to have a second resistance value to detect the voltage with the second current portion rectified by the rectifier; and an over current protecting part having one end connected to the secondary winding wire of the transformer, and another end connected to a feedback line connected to the controller to prevent an excessive tube current from passing through the lamp, wherein the first resistance has a resistance value in range of about 200Ω to 430Ω and the second resistance has a resistance value in a range of 15 kΩ to 35 kΩ.

11. The apparatus according to claim 10, further comprising a diode connected between the second resistance and the controller to drop the voltage detected by the second resistance.

12. The apparatus according to claim 10, further comprising a diode connected between the rectifier and the second resistance to drop a voltage detected by the rectifier.

* * * * *